US006546842B2

(12) United States Patent
Raikamo

(10) Patent No.: US 6,546,842 B2
(45) Date of Patent: Apr. 15, 2003

(54) POWER UNIT FOR POSITIONING VALVES, OR THE LIKE, INTO DESIRED POSITION

(76) Inventor: Esko Raikamo, Rajasillantie, FIN-33880 Lempäälä (FI)

( * ) Notice: Subject to any disclaimer, the term of this patent is extended or adjusted under 35 U.S.C. 154(b) by 0 days.

(21) Appl. No.: 10/060,025

(22) Filed: Jan. 29, 2002

(65) Prior Publication Data

US 2002/0096044 A1 Jul. 25, 2002

Related U.S. Application Data

(63) Continuation of application No. PCT/FI00/00694, filed on Aug. 16, 2000.

(30) Foreign Application Priority Data

Aug. 17, 1999 (FI) ..... 991743

(51) Int. Cl.[7] ..... F01C 9/00
(52) U.S. Cl. ..... 92/121; 91/167 A
(58) Field of Search ..... 91/167 A, 173; 92/121, 57

(56) References Cited

U.S. PATENT DOCUMENTS 2,911,956 A * 11/1959 Smith, Jr. ..... 91/167 A
3,732,786 A * 5/1973 Grosseau ..... 91/167 A

* cited by examiner

*Primary Examiner*—Edward K. Look
*Assistant Examiner*—Michael Leslie
(74) *Attorney, Agent, or Firm*—Ladas & Parry

(57) ABSTRACT

A pressure-fluid-operated power unit producing a rotating motion for positioning valves or similar actuators into a desired position. The power unit comprises an annular cylinder space and at least two pairs of pistons arranged to move in said cylinder space respect to each other, first pistons of the piston pairs being arranged to rotate around the shaft of the cylinder space and second pistons being immovably arranged with respect to at least one end flange of the cylinder space or to a casing of the cylinder space, and pressure fluid conduits for leading pressure fluid into and out of the spaces between the pistons.

6 Claims, 4 Drawing Sheets

19
20
34
33
27
24b
32
31
6b
11
24a
16
2
18
12
19
20
21
22
3'
4
5'
6a
6d
6a 6b
14a
14b
14c
17
6c
24a 6d
14d
14e
24b
14f
6f
6e

POWER UNIT FOR POSITIONING VALVES, OR THE LIKE, INTO DESIRED POSITION

This application is a Continuation of International Application PCT/FI00/00694 filed on Aug. 16, 2000, which designated the U.S. and was published under PCT Article 21(2) in English.

The invention relates to a pressure-fluid-operated power unit producing a rotating motion for positioning valves, or similar actuators, into a desired position, the rotating motion of the actuator being a multiple of about 90°, the power unit comprising a cylindrical casing, a first end flange and a second end flange being provided at the ends of the casing, an annular cylinder space, and at least two pairs of pistons, the pistons being movable with respect to each other and substantially of the same shape and size as the cross-section of the cylinder space, the first pistons in each piston pair being movably arranged with respect to the cylinder space, the first pistons rotating about its axis so that the first pistons can move in the cylinder space in the direction of its circumference; and the second pistons of the piston pair adjacent to the second end flange being immovably arranged with respect to the second end flange of the cylinder space or the casing of the cylinder space; and a transmission shaft arranged to rotate about the axis of the cylinder space with said first pistons for transmitting power for the positioning of the actuator.

Various actuators having a control member the position of which is rotatably adjustable and an adjusting range which is a multiple of substantially 90° are widely known. Such actuators include various valves, for example. Often these actuators are set to a desired position using power units which are typically pressure-fluid-operated.

In prior art pressure-fluid-operated power units the energy of the pressure fluid is usually converted to a motion of a usually linearly moving piston or similar member, the motion being further converted to a rotating motion for example by applying a gear rack and gearwheel, a lever or other similar transmission means. Power units are therefore often complicated in structure, and their manufacturing and maintenance is expensive and time-consuming. Such power units naturally require a fairly large space, which makes them difficult to position in connection with actuators. The power of a power unit is also relatively low with respect to the space it requires. Furthermore, complicated power transmission solutions cause looseness and tolerance which impede the accurate adjustment of the actuator and which become worse during the service life of the actuator.

An object of the present invention is to provide a power unit where the above drawbacks are eliminated.

The power unit of the invention is characterized in that the power unit comprises at least one additional annular cylinder space arranged co-axially with the cylinder space between the first end flange and the second end flange; that the cylinder space adjacent to the additional cylinder space and/or additional cylinder spaces are separated from each other by an intermediate flange which is arranged to move with respect to the cylinder space and the additional cylinder spaces and the and the transmission shaft, the flange rotating about their axis; that the additional cylinder space is provided with at least two pairs of additional pistons, the additional pistons of which are substantially of the same shape and size as the cross-section of the additional cylinder space; that the second additional pistons of the additional piston pairs arranged to the additional cylinder space limited by the second end flange are immovably fastened with regard to the second end flange or the casing of the cylinder space, the second additional pistons arranged to other additional cylinder spaces and the second pistons of the cylinder space being fastened to the intermediate flange, on the opposite side of which are fastened the first additional pistons of the adjacent additional cylinder space; that additional piston pairs arranged into one and the same additional cylinder space can move with respect to each other in the direction of the circumference of the additional cylinder space; and pressure fluid conduits for leading pressure fluid into and out of the spaces between the additional pistons.

An essential idea of the invention is that the power unit comprises an annular cylinder space and at least two pairs of pistons arranged into said cylinder space and moving with respect to each other, a first piston in the piston pairs being arranged to rotate about the axis of the cylinder space and a second piston being immovably arranged with respect to at least one end flange of the cylinder space or the casing of the cylinder space; and pressure fluid conduits for leading pressure fluid into and out of the spaces between the pistons. A further idea of the invention is that the power unit comprises a transmission shaft for transmitting the motion of the pistons that are arranged to rotate with respect to the cylinder space to the control members of an actuator, for setting the position of the control members.

In addition, an idea of a preferred embodiment is that an additional cylinder space is provided co-axially with the cylinder space; that the cylinder space and the additional cylinder space are separated from each other by an intermediate flange which is arranged to rotate about the shaft of the cylinder space and the power transmission means, second pistons of the pistons pairs being immovably arranged on the cylinder side of the flange; and that the additional cylinder space is provided with at least two additional piston pairs, a first additional piston of which is immovably arranged on the additional cylinder space side of the intermediate flange, a second additional piston being immovably arranged to the flange closing the additional cylinder space in such a way that the additional pistons can rotate in the direction of the circumference of the additional cylinder space, whereby the transmission shaft can be rotated with respect to the flange closing the additional cylinder space by feeding pressure fluid into both the cylinder space and the additional cylinder space, thereby allowing the maximum angle of rotation of the transmission shaft to be increased.

A second preferred embodiment is based on the idea that the transmission shaft is arranged directly to the shaft of the power unit's actuator, the arrangement between the power unit and the actuator being as simple as possible. A third preferred embodiment is based on the idea that the pressure fluid in the power unit is a water-based liquid, or steam. The pressure fluid can also be a process liquid.

An advantage of the invention is that the power unit is small with respect to its control power, therefore the unit can be placed even into a narrow space. A further advantage is that the structure of the power unit is simple, whereby its manufacturing and maintenance costs are low. The power unit produces a rotating motion directly, therefore any power transmission means complicating its structure are not needed between the power unit and the actuator. The number of the additional cylinder spaces is easy to select, whereby the greatest possible rotating motion of the power unit is simple to increase. Yet another advantage is that in the power unit of the invention, either water or an aqueous solution can be used as pressure fluid, the actuator thus being extremely safe, environmentally friendly and economical to use.

The invention will be described in greater detail in the accompanying drawings, in which FIG. 1 is a schematic, partly sectional view of an embodiment of a power unit of the invention seen from an axial direction;

Figure 1:
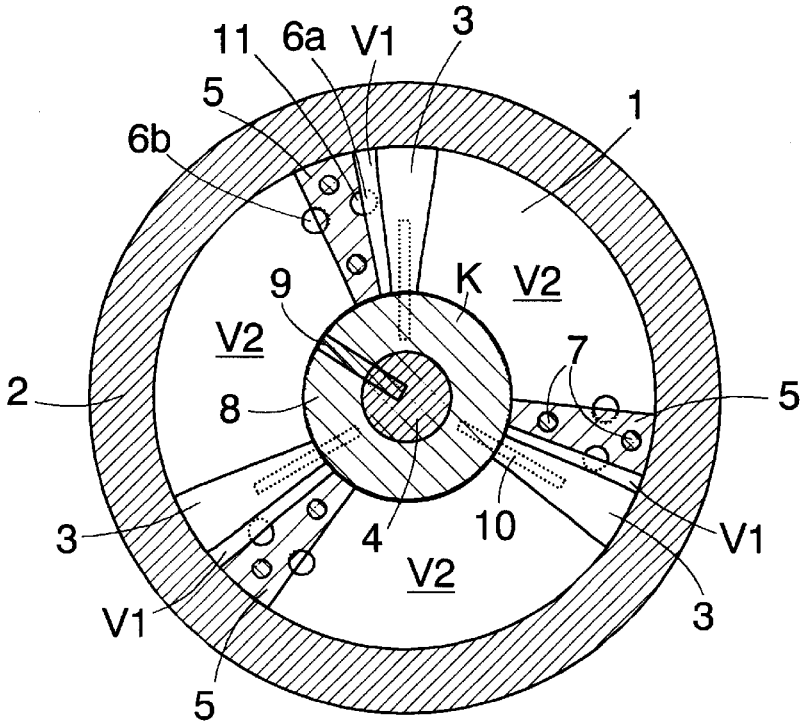

FIG. 1 is a schematic, partly sectional view of an embodiment of a power unit of the invention seen from an axial direction. The power unit comprises an annular, closed cylinder space 1 surrounded by a cylinder space casing 2. In the middle of the cylinder space 1 there is a transmission shaft 4 which is arranged co-axially with the cylinder space and rotatably in relation to one end flange, a sleeve 8 being immovably arranged to the shaft. To the sleeve 8 are arranged first pistons 3 which are fastened to the sleeve symmetrically with respect to the cylinder space 1 and which rotate in the direction of the circumference of the cylinder space, the pistons being substantially of the same shape as the cross-section of the cylinder space 1. In the embodiment shown in FIG. 1 the sleeve 8 is fastened to the transmission shaft 4 and the first pistons 3 to the sleeve by means of tenon jointings 9, 10, or the like.

The end flanges closing the cylinder space 1 are provided with three second pistons 5 arranged immovably with respect to the end flanges and symmetrically with respect to the cylinder space 1, the pistons being substantially of the same size and shape as the cross-section of the cylinder space 1. The first pistons 3 and the second pistons 5 form three piston pairs, the pistons 3, 5 in the pairs being arranged to move with respect to each other. The second pistons 5 are fastened to the flanges by means of tenons 7 which go through the pistons and the ends of which fit into recesses produced to the end flanges. It is to be noted that for clarity of illustration the Figure does not show the end flanges.

Further, first pressure fluid conduits 6*a* and second pressure fluid conduits 6*b* are arranged through the end flanges to the cylinder space 1, to feed pressure fluid into and out of the cylinder space 1. The pressure fluid conduits 6*a*, 6*b* are arranged in such a way that the first pressure fluid conduits 6*a* are arranged to the first end flange and the second pressure conduits 6*b* to the second end flange. The pressure fluid conduits 6*a*, 6*b* are connected to both sides of the second pistons 5: the first conduits 6*a* to a part of the cylinder space 1 indicated with reference V1, and the second conduits 6*b* to a part of the cylinder space 1 indicated, correspondingly, with reference V2. The pressure fluid means 6*a*, 6*b* are arranged to the end flanges in such a way that their openings on the cylinder space 1 side are partly behind the second pistons 5. Grooves 11 are therefore formed onto the second pistons 5, at points corresponding to the pressure fluid conduits 6*a*, 6*b*, the grooves extending in the direction of the piston 5 surface at a distance from the flange and from the opening of the pressure fluid conduit 6*a*, 6*b*, thereby allowing the pressure fluid to freely flow through the conduits 6*a*, 6*b* into and out of the cylinder space 1. The described arrangement of the conduits 6*a*, 6*b* allows the cross-sectional surface of the conduits 6*a*, 6*b* to be increased with the aim of reducing flow resistance without unnecessarily restricting the motion of the first piston 3 and the second piston 5 with respect to each other. The grooves 11 can naturally also be formed to the first pistons 3, or in another manner.

When the transmission shaft 4 is to be rotated with respect to the end flange into the direction indicated with an arrow K, the pressure fluid is fed through the first conduits 6*a* to the part V1 in the cylinder space 1. The second pressure fluid conduits 6*b* being open to the part V2 at the same time, the pressure of the pressure fluid in the part V1 causes the piston 5 to move and the transmission shaft 4 to rotate to the direction shown with the arrow K, whereby pressure fluid flows out of the part V2 through the second conduits 6*b*. The transmission shaft 3 rotates to an opposite direction in relation to the direction K in a corresponding manner when pressure fluid is fed through the second conduits 6*b* to the part V2 and the first pressure fluid conduits 6*a* are kept open for the pressure fluid to be led out of the part V1. In the embodiment shown in the Figure the maximum continuous rotating motion of the transmission shaft 4 is about 90°. The pistons 5, 6 can be shaped or their number changed to increase or reduce the angle of the maximum continuous rotating motion.

Figure 2:
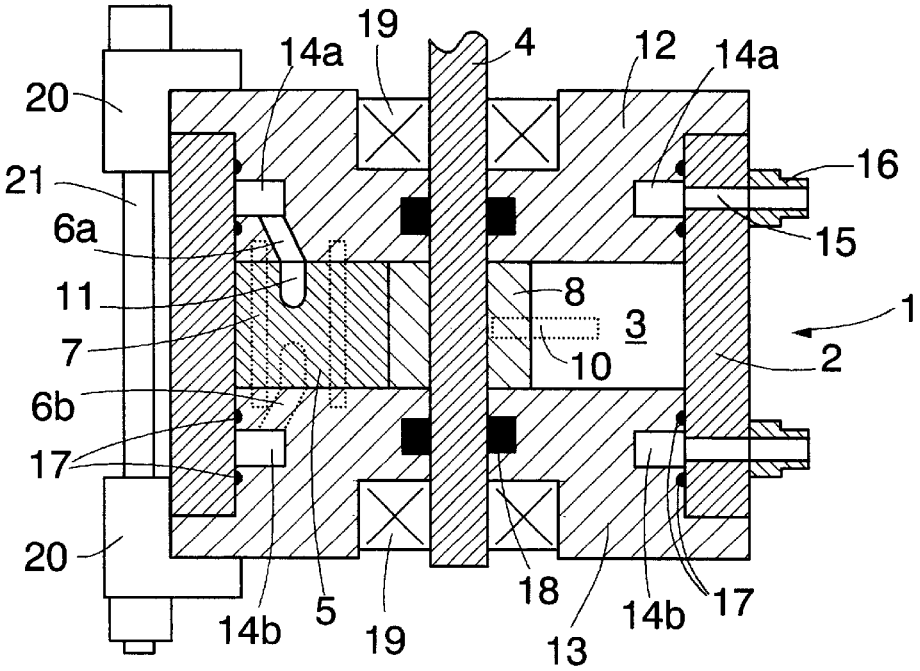
FIG. 2 is a schematic, partly sectional side view of the embodiment of the power unit of the invention shown in FIG. 1.

FIG. 2 is a schematic sectional side view of the embodiment of the power unit of the invention shown in FIG. 1. The reference numerals used in the Figure correspond to those in FIG. 1. The power unit comprises the cylinder space 1 restricted by the casing 2, a first end flange 12 and a second end flange 13. The transmission shaft 4 is arranged co-axially with the cylinder space 1, the shaft being mounted for instance in slide or ball bearings 19 to each end flange 12, 13. In addition, a lead-through of the transmission shaft 4 in the end flanges 12, 13 is sealed with a shaft seal 18. The end flanges 12, 13 are also provided with second pistons 5 arranged immovably with respect to the end flanges. The first pistons 3, in turn, are fastened to the sleeve 8 with a tenon 10, the sleeve 8 being further fastened to the transmission shaft 4 with a tenon. Both the first pistons 3 and the second pistons 5 are substantially of the same shape and size as the cross-section of the cylinder space 1.

Similarly as described in connection with FIG. 1, first pressure fluid conduits 6*a* and second pressure fluid conduits 6*b* lead to the cylinder space 1. The first pressure fluid conduits 6*a* lead to a pressure fluid connecting conduit 14*a* formed by the casing 2 and a groove made on the outer circumference of the first end flange 12 for example by turning or in another appropriate manner, the connecting conduit surrounding substantially entirely the first end flange 12. Correspondingly, the second pressure fluid conduits 6*b* are connected to a connecting conduit 14*b* arranged to the second end flange 13. Further, both connecting conduits 14*a*, 14*b* lead out of the power unit through connecting channels 15 and pressure couplers 16 going through the casing 2. On both sides of the connecting conduits 14*a*, 14*b* there are seals 17, such as O-ring seals, which seal the end flange 12, 13 to the casing 2 in such a way that pressure fluid cannot leak out of the connecting conduit 14*a*, 14*b*.

The power unit can be disassembled and assembled simply by opening and closing fastening members 21 arranged between fastening collars 20 that encircle the end flanges 12, 13. The end flanges 12, 13 are preferably similar to each other. The structure of the power unit is very simple; it comprises only a few parts and therefore it is economical to manufacture and operationally reliable.

The transmission shaft 4 can be either directly connected to a control member of a controllable actuator, for instance to a control shaft of a flow valve, or the transmission shaft 4 can be provided with a gear wheel or a lever, for example, which transmit the motion of the power unit to the actuator. Depending on the application, the power unit is immovably fastened for example from the casing 2, the end flange 12, 13 or from the fastening collar 20 to a suitable fastening point not shown in the Figure for the sake of simplicity. The fastening point can be for example the frame of the actuator used by the power unit.

Figure 3:
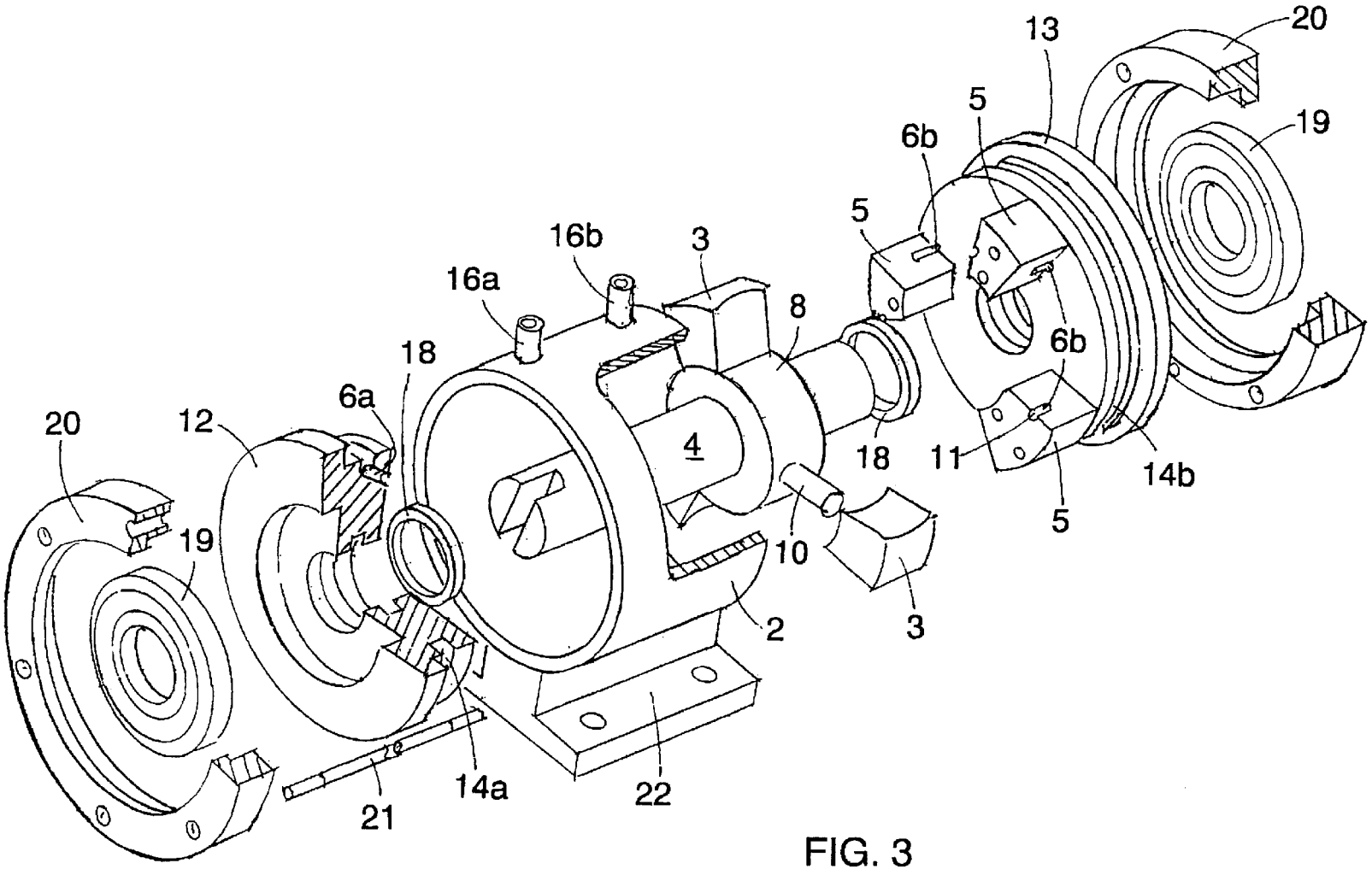
FIG. 3 is a schematic view of a second embodiment of the power unit of the invention seen as an exploded perspective view.

FIG. 3 schematically illustrates an exploded perspective view of a second embodiment of the power unit of the invention. The reference numerals used in FIG. 3 correspond to those used in the previous Figures. The casing 2 surrounding the annular cylinder space 1 is provided with couplers 16*a*, 16*b* to lead pressure fluid into and out of the power unit. Each coupler 16*a*, 16*b* is connected to a separate connecting conduit 14*a*, 14*b*, the pressure fluid conduits 6*a*, 6*b* leading from the connecting conduits further to the cylinder space 1.

To provide a fastening means, the casing 2 is provided with a fastening base 22 for fastening the frame of the power unit with tenons or similar fastening means to a suitable location. In this context, the frame of the power unit comprises the entity formed by the end flanges 12, 13 and the casing 2. The fastening means can naturally be different from that shown in the Figure. Since the connecting conduits 14*a*, 14*b* surround substantially the entire end flange 12, 13, the pressure couplers 16 can be freely positioned with respect to the fastening bed 22 to a suitable location on the circumference of the casing 2. The first pistons 3 are arranged to the sleeve 8 with tenons 10 which fit tightly into holes made to the pistons 3 and the sleeve 8. Both the second pistons 5 and the first pistons 3 can be manufactured by cutting a disciform blank, for example. Each one of the second pistons 5 is fastened to the end flanges 12, 13 by two tenons 7 extending through the piston. Instead of the tenons 7, 10, the pistons 3, 5 and the sleeve 8 can naturally be fastened by other fastening means and methods known per se, such as bolts, stud bolts, cotter joints, welding, gluing, or the like.

The sleeve 8 and the first pistons 3 can also form one integral piece, in which case the tenons 10 are naturally not needed. The integral piece comprising the first pistons 3 and the sleeve 8 can be manufactured for example by processing a casting. The combining of the first pistons 3 and the sleeve 8 is particularly advantageous when they are made of plastic. The first pistons 3 and the sleeve 8 can then be made by extruding a continuous profile comprising the sleeve and the pistons, suitable portions being then cut off from the profile and arranged to the power unit. The transmission shaft 4 and their first pistons 3 can also be fastened to each other directly without an intermediate sleeve. In this case the transmission shaft 4 and the first pistons 3 can form a uniform piece, and they can be manufactured using a suitable plastic material, for example.

In a preferred embodiment which is particularly suitable for small pressure fluid pressures, the main parts of the power unit, such as the casing 2, pistons 3, 5 and the end flanges 12, 13 are manufactured of suitable plastic materials, instead of conventional metal materials used in mechanical engineering, a particularly light structure being thereby obtained. The pressure fluid used in a power unit made of plastic can advantageously be water, which is cheap, safe and environmentally friendly. The surfaces of the first pistons 3 and second pistons 5 that face the cylinder space 1 can be made concave, the pressure of the pressure fluid acting on a piston thus spreading the edges of the surfaces in question in a suitable manner, thereby sealing the piston against its counter surface.

Figure 4:
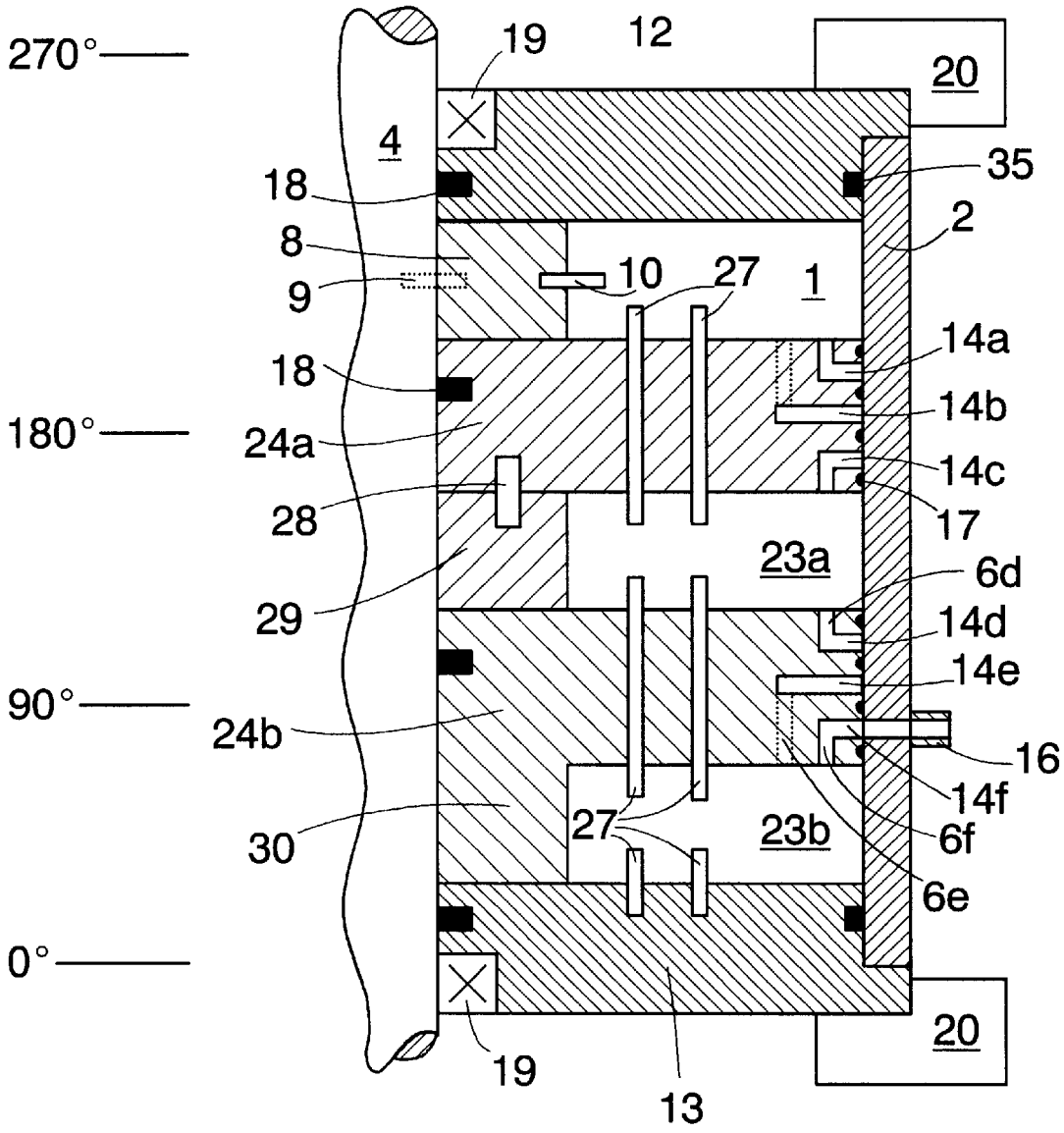
FIG. 4 is a schematic, partly sectional side view of a third embodiment of the power unit of the invention.

FIG. 4 is a partly sectional, schematic side view of a third embodiment of the power unit of the invention. The power unit comprises, in addition to the cylinder space 1, an annular first additional cylinder space 23*a* and second additional cylinder space 23*b*. The first additional cylinder space 23*a* is separated from the cylinder space 1 with a first intermediate flange 24*a* and further from the second additional cylinder space 23*b* with a second intermediate flange 24*b*. Further, the second additional cylinder space 23*b* is closed with a second end flange 13. The intermediate flanges 24*a*, 24*b* are movably arranged with respect to the shaft 4, casing 2 and the end flanges 12, 13 in such a way that the intermediate flanges 24*a*, 24*b* can rotate with respect to the cylinder space 1 and the additional cylinder spaces 23*a*, 23*b* about the transmission shaft 4. The intermediate flanges 24*a*, 24*b* are preferably mounted for example in slide bearings to the transmission shaft 4.

To transmission shaft 4 is fastened a sleeve 8 by means of a tenon 9, the first pistons being fastened to the sleeve 8 by fastening tenons 10. For clarity of illustration, the first pistons are not shown in the Figure. Correspondingly, the second pistons located in the cylinder space 1 (not shown in the Figure either) are fastened to the first intermediate flange 24*a* by means of fastening tenons 27. In other words, the second pistons are movably arranged with respect to the first end flange 12. The fastening of the sleeve 8 to the transmission shaft 4 and that of the pistons to the sleeve 8 and the intermediate flange 24*a* can naturally be carried out in another alternative way known per se.

The first pistons in the additional piston pairs arranged into the first additional cylinder space 23*a* are fastened to the side of first intermediate flange 24*a* facing the additional cylinder space 23*a* with fastening tenons 27, the second pistons being correspondingly arranged to the second intermediate flange 24*b*. The intermediate flanges 24*a*, 24*b* and the additional pistons fastened to them can move with respect to each other in the direction of the circumference of the additional cylinder space 23*a*. The first pistons in the additional piston pairs arranged to the second additional cylinder space 23*b* are correspondingly fastened with fastening tenons 27 to the side of the second intermediate flange 24*b* facing the second additional cylinder space 23*b*, and the second pistons correspondingly to the second end flange 13, which allows the additional pistons to move with respect to each other in the direction of the circumference of the second additional cylinder space 23*b*. Both the pistons and the additional pistons are arranged symmetrically with respect to their cylinder spaces.

In order to allow the additional pistons to be made in the same size as the pistons 3, 5, the additional cylinders are both provided with sleeve structures corresponding to the sleeves 8. In the first additional cylinder 23*a*, the sleeve structure is provided by means of a sleeve 29 fastened to the intermediate flange 24*a* with a fastening means 28, whereas the sleeve structure of the second additional cylinder 23*b* is provided by means of a collar-like structure 30 which forms an integral part of the second intermediate flange 24*b*.

The connecting conduits 14*a* to 14*f* for the pressure fluid and the pressure fluid conduits 6*a* to 6*f* leading to the cylinder space 1 and the additional cylinder spaces 23*a*, 23*b* are arranged to the intermediate flanges 24*a* and 24*b*. The first and the second connecting conduits 14*a*, 14*b* made into the first intermediate flange 24*a* lead to the cylinder space 1, and the fifth and the sixth connecting conduits 14*e*, 14*f* made into the second intermediate flange 24*b* lead to the second additional cylinder space 23*b*. The third connecting conduit 14*c* leading to the first additional cylinder space 23*a* is made into the first intermediate flange 24*a*, and the fourth conduit 14*d* into the second intermediate flange 24*b*. The second and the fourth connecting conduits 14*b*, 14*e*, which are the middlemost conduits in the intermediate flanges 24*a*, 24*b*, are made deeper than the outermost first and sixth connecting conduits 14*a*, 14*f* connected to the same cylinder spaces, suitable pressure fluid conduits 6*b*, 6*e* thus being easy to arrange to the middlemost connecting conduits 14*b*, 14*e* for example by drilling or in another similar way. The connecting conduits are separated from each other and the cylinder spaces with seals 17. The connecting conduits 14*a* to 14*f* are coupled to a pressure fluid source with pressure fluid coupler 16 arranged to the casing 2. To simplify the illustration, the Figure only shows the pressure fluid coupler 16 at the sixth connecting conduit 14*f*.

For example, the pressure fluid conduits 6*e* and 6*f* arranged to the fifth and the sixth connecting conduits 14*e*, 14*f* are connected to the second additional cylinder space 23*b* and, more precisely, to the opposite sides of the additional piston fastened to the second intermediate flange 24*b* in the second cylinder space 23*b*. Similar conduits lead in a corresponding manner from said fifth and sixth connecting conduits 14*e*, 14*f* to the opposite sides of each of the additional pistons fastened to the second intermediate flange 24*b*. The fourth connecting conduit 14*d*, in turn, is connected to the first additional cylinder space 23*a* through the pressure fluid conduit 6*d* in the above described manner. Correspondingly, the first and the second connecting conduits 14*a*, 14*b* of the connecting conduits of the first intermediate flange are connected to the opposite sides of the pistons arranged to the cylinder space 1 and fastened to the first intermediate flange 24*a*, and the third connecting conduit 14*c* is connected to the other side of the additional pistons fastened to the first intermediate flange 24*a* of the first additional cylinder space 23*a*. The pressure fluid conduits 6*c*, 6*d* of the first additional cylinder space 23*a* are naturally arranged to lead to both sides of the additional pistons.

In the embodiment of the invention shown in FIG. 4, the cylinder space 1, the first additional cylinder space 23*a* and the second additional cylinder space 23*b* are provided with three piston pairs, for example, similarly symmetrically to the corresponding cylinder space as shown in FIGS. 1 to 3. To clarify the illustration, the Figure does not show the pistons. Consequently, in each cylinder space, i.e. in the cylinder space 1 as well as in both additional cylinder spaces 23*a*, 23*b*, the maximum rotating motion of the piston pairs is about 90°. Since at least one piston in each piston pair or additional piston pair is fastened to the same rotatably connected intermediate flange 24*a*, 24*b* as one of the pistons in a piston pair in the adjacent cylinder space, the motion of the piston pairs can be combined by guiding the pressure fluid in a suitable manner to obtain a maximum rotating motion of 3×90°=270° between the transmission shaft and the frame of the power unit. To illustrate this, the angles of rotation of the intermediate flanges 24*a*, 24*b* and the transmission shaft 4 with respect to the second end flange 13 forming part of the frame are shown when the shaft is rotated said 270°. When the transmission shaft 4 is to be rotated less, 180° for example, the rotation can be carried out by locking the additional piston pairs of the second additional cylinder space 23*b* with respect to each other and by using the pressure fluid to rotate the piston pairs of the cylinder space 1 and the first additional cylinder space 23*a* 90° to the same direction with respect to each other. The additional piston pairs can be locked with respect to each other for example by closing the flow of the pressure fluid either to one side of the additional piston pairs of the additional cylinder space 23*a*, 23*b* or to both sides of them, or by maintaining a negative pressure on one side of the additional piston pairs by removing pressure fluid from that side. The piston pairs in the cylinder space 1 can be locked with respect to each other in the same way. Another alternative to obtain the angle of rotation of 180° is to lock the piston pairs of the first additional cylinder 23*a* and to rotate the piston pairs of the cylinder space 1 and the additional cylinder space 23*b* with respect to each other. Correspondingly, an angle of rotation of 90° is obtained by locking the piston pairs of either both the additional cylinder spaces 23*a*, 23*b*, or the pistons of one of the additional cylinder spaces 23*a*, 23*b* and the cylinder space 1. The piston pairs in the cylinder space 1 can be rotated with respect to each other even if there would be no pressure in the additional cylinder spaces 23*a*, 23*b*. The reason for this is that the pressure of the pressure fluid in the cylinder space 1 presses the first intermediate flange 24*a* and further the second intermediate flange 24*b* away from the cylinder space 1 in the direction of the transmission shaft 4 against the second end flange 13, the friction caused by the pressing locking the first intermediate flange 24*a* to place. This allows the pistons which are immovably arranged with respect to the transmission shaft 4 to be rotated with respect to the first intermediate flange 24*a*. Correspondingly, if pressure of the pressure fluid remains in the cylinder space 1 or in the additional cylinder space 23*a*, 23*b*, the friction forces caused by the pressure and acting on the intermediate flanges 24*a*, 24*b* lock the transmission shaft 4 into its current position. The transmission shaft 4 can also be locked into position by using the pressure fluid to lock the piston pairs of all the cylinder spaces 1, 23*a* and 23*b* with respect to each other. On the other hand, by opening all the pressure fluid conduits, the transmission shaft 4 can be released to freely rotate 270° with respect to the frame of the power unit.

The number of piston pairs arranged into the cylinder space 1 and the additional cylinder spaces 23*a*, 23*b* can also be other than three; when the number of pistons decreases, the angle of rotation between the piston pairs of cylinder space 1 or the additional cylinder spaces 23*a*, 23*b* increases.

The power unit can be provided with one or more additional cylinder spaces 23*a*, 23*b*, depending on the requirements of the application in question. The number of the additional cylinder spaces 23*a*, 23*b*, i.e. the maximum angle of rotation, is easy to decide: a necessary number of intermediate flanges 24*a*, 24*b* is simply piled into the casing 2 which is then suitably dimensioned.

Figures 5A, 5B, 5C:
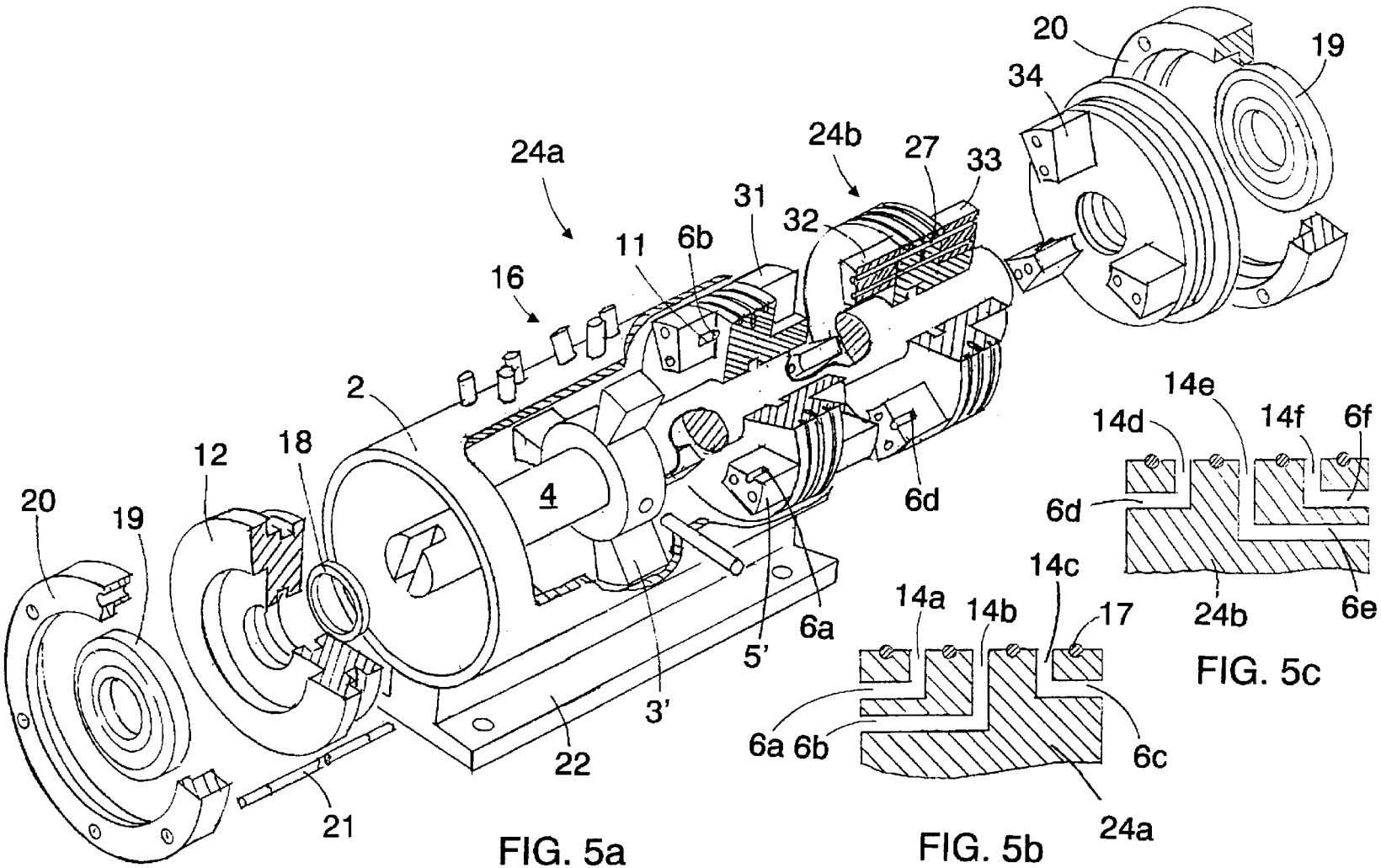
FIG. 5*a* schematically illustrates an exploded perspective view of the embodiment of the power unit of the invention shown in FIG. 4, FIGS. 5*b* and 5*c* illustrating some details of FIG. 5*a* in section.

FIG. 5*a* schematically illustrates an exploded perspective view of the embodiment of the power unit of the invention shown in FIG. 4, FIGS. 5*b*, 5*c* schematically illustrating a sectional view of some of the details of FIG. 5*a*. The cylinder space 1 of the power unit comprises three piston pairs arranged symmetrically with respect to the cylinder space 1, each piston pair comprising a first piston 3' and a second piston 5'. The first additional cylinder space 23*a* includes three similarly arranged additional piston pairs, each of the pairs comprising a first additional piston 31 and a second additional piston 32. Further, three additional piston pairs are arranged into the second additional cylinder space 23*b*, the piston pairs each comprising a first additional piston 33 and a second additional piston 34. The basic shape of the pistons 3', 5' and the additional pistons 31 to 34 is the same, and therefore all the pistons can be manufactured applying similar blanks and basically similar work processes. The first pistons 3' and the second additional pistons 34 of the second additional cylinder are not provided with pressure fluid conduits, and they are preferably identical, except for the drillings required for their fastening or for other similar fastening members. The second pistons 5' and the additional first pistons 33 of the second additional cylinder space are preferably fully identical, because grooves 11 are arranged for the pressure fluid conduits on both sides of the pistons. Further, the first and the second additional pistons 31, 32 of the first additional cylinder are preferably similar, a groove 11 being arranged for the pressure fluid conduits on one side of the additional cylinders.

FIGS. 5*b* and 5*c* show a detail of the structure of the pressure fluid conduits of the first intermediate flange 24*a* and those of the second intermediate flange 24*b*. The connecting conduits 14*a* to 14*f* and the sealing grooves of seals 17 bordering them are made for example by turning or by another method well known to a person skilled in the art. The pressure fluid conduits 6*a* to 6*f* between the connecting conduits 14*a* to 14*f* in turn are made for example by drilling. The pressure fluid conduits 6*a* to 6*f* shown in the Figures are arranged substantially perpendicular to the intermediate flange 24*a*, 24*b*, but they can also be arranged at a different angle.

The drawings and the related specification are only meant to illustrate the inventive idea. The details of the invention may vary within the scope of the claims. The cross-section of the pistons 3, 5 and the additional pistons 31 to 34 in the direction of the shaft 4 can therefore be different from that shown in the Figures. Similarly, the size of the pistons 3, 5 and the additional pistons 31 to 34, and the number of pistons arranged into the cylinder and additional cylinder spaces 1, 23*a*, 23*b* can also vary. The pressure fluid used in the power unit of the invention can be selected among various gases, gas mixtures or hydraulic fluids.

What is claimed is:

1. A pressure-fluid-operated power unit producing a rotating motion for positioning valves, or similar actuators, into a desired position, the rotating motion of the actuator being a multiple of about 90°, the power unit comprising:

a cylindrical casing, a first end flange and a second end flange being provided at the ends of the casing;

an annular cylinder space;

at least two pairs of pistons, the pistons being movable with respect to each other and substantially of the same shape and size as the cross-section of the cylinder space, the first pistons in each piston pair being movably arranged with respect to the cylinder space, the first pistons rotating about its axis to allow the first pistons to move in the cylinder space in the direction of its circumference, and the second pistons of the piston pair adjacent to the second end flange being immovably arranged with respect to the second end flange or the casing of the cylinder space;

a transmission shaft arranged to rotate about the axis of the cylinder space with said first pistons for transmitting power for the positioning of the actuator;

at least one additional annular cylinder space being arranged coaxially with the cylinder space between the first end flange and the second end flange;

the cylinder space adjacent to the additional cylinder space and additional cylinder spaces being separated from each other by an intermediate flange which is arranged to move with respect to the cylinder space and the additional cylinder spaces and the transmission shaft, the flange rotating about their axis;

the additional cylinder space being provided with at least two pairs of additional pistons, the additional pistons of which are substantially of the same shape and size as the cross-section of the additional cylinder space;

second additional pistons of the additional piston pairs being arranged to the additional cylinder space limited by the second end flange are immovably fastened with regard to the second end flange or the casing of the cylinder space, and second additional pistons being arranged to other additional cylinder spaces as well as second pistons of the cylinder space being fastened to the intermediate flange, on the opposite side of which are fastened the first additional pistons of the adjacent additional cylinder space;

additional piston pairs being arranged into one and the same additional cylinder space being movable with respect to each other in the direction of the circumference of the additional cylinder space;

pressure fluid conduits for leading pressure fluid into and out of the spaces between the pistons and the additional pistons.

2. A power unit according to claim 1, wherein the transmission shaft is the actuator's control shaft.

3. A power unit according to claim 1, wherein the frames of the power unit and the actuator are fastened to each other.

4. A power unit according to claim 1, wherein the pressure fluid conduits of the power unit comprise a connecting conduit surrounding substantially entirely the outer circumference of the end flange and/or the intermediate flange of the power unit and a pressure fluid conduit leading from the connecting conduit to the cylinder space or to the additional cylinder space.

5. A power unit according to claim 1, wherein the power unit is mainly manufactured of plastic.

6. A power unit according to claim 1, wherein the maximum rotating motion between the first and second piston of the piston pair and the first and second additional piston of the additional piston pair is about 90°.

* * * * *

UNITED STATES PATENT AND TRADEMARK OFFICE

CERTIFICATE OF CORRECTION

PATENT NO. : 6,546,842 B2
DATED : April 15, 2003
INVENTOR(S) : Esko Raikamo

It is certified that error appears in the above-identified patent and that said Letters Patent is hereby corrected as shown below:

Title page,
Item [30], delete "991743" and insert -- 19991743 --.

Signed and Sealed this

Twenty-third Day of September, 2003

JAMES E. ROGAN
*Director of the United States Patent and Trademark Office*